US007144097B2

(12) United States Patent
Ando et al.

(10) Patent No.: US 7,144,097 B2
(45) Date of Patent: Dec. 5, 2006

(54) INKJET RECORDING DEVICE AND INKJET RECORDING METHOD

(75) Inventors: Ryo Ando, Kanagawa (JP); Hiroaki Satoh, Kanagawa (JP); Satoru Nishikawa, Kanagawa (JP); Kozo Tagawa, Kanagawa (JP); Takeshi Kato, Kanagawa (JP); Tsutomu Udaka, Kanagawa (JP); Toshiyuki Kazama, Kanagawa (JP); Yoshiki Matsuzaki, Kanagawa (JP); Osamu Goto, Kanagawa (JP); Susumu Kibayashi, Kanagawa (JP); Yoshihiko Mitamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 309 days.

(21) Appl. No.: 10/923,809

(22) Filed: Aug. 24, 2004

(65) Prior Publication Data

US 2005/0046667 A1 Mar. 3, 2005

(30) Foreign Application Priority Data

Aug. 27, 2003 (JP) ..... 2003-302800

(51) Int. Cl.
*B41J 2/15* (2006.01)
*B41J 2/145* (2006.01)

(52) U.S. Cl. ..... 347/40

(58) Field of Classification Search ..... None
See application file for complete search history.

(56) References Cited

U.S. PATENT DOCUMENTS 5,906,156 A * 5/1999 Shibuya et al. ..... 101/93.12
6,309,046 B1 * 10/2001 Izawa et al. ..... 347/40

FOREIGN PATENT DOCUMENTS

| | | |
|---|---|---|
| JP | 2-179754 | 7/1990 |
| JP | 5-330030 | 12/1993 |
| JP | 8-132700 | 5/1996 |
| JP | 2693224 | 9/1997 |

* cited by examiner

*Primary Examiner*—Thinh Nguyen
(74) *Attorney, Agent, or Firm*—Morgan, Lewis & Bockius, LLP

(57) ABSTRACT

Provided is an inkjet recording device that has a conveying unit for conveying a recording medium, plural recording head groups each structured by plural unit heads disposed along the conveying direction, and an ink receiving unit for receiving ink discharged from the unit heads. The recording head groups, correspond respectively to plural individual recording regions which are sectioned off in the recording medium transverse direction which is orthogonal to the conveying direction, are disposed so as to be at respectively different positions at adjacent individual recording regions along the conveying direction. The ink receiving unit is disposed so as to face ink drop discharging surfaces of the unit heads. The conveying unit is plural conveying belts disposed at positions evading trajectories of the ink drops from the unit heads as seen in a direction of a line normal to the recording medium so as to be divided in the conveying direction.

18 Claims, 13 Drawing Sheets

INKJET RECORDING DEVICE AND INKJET RECORDING METHOD

CROSS-REFERENCE TO RELATED APPLICATION

This application claims priority under 35 USC 119 from Japanese Patent Application No.2003-302800, the disclosure of which is incorporated by reference herein.

BACKGROUND OF THE INVENTION

1. Field of the Invention

The present invention relates to an inkjet recording device and an inkjet recording method, and in particular, to an inkjet recording device which carries out recording by discharging ink drops onto a recording medium, and to an inkjet recording method which records an image on a recording medium by the inkjet recording device.

2. Description of the Related Art

Among inkjet recording devices which record an image by discharging ink drops onto a recording medium such as a sheet or the like, there are so-called scanning inkjet recording devices in which an inkjet recording head is installed at a moving member such as a carriage or the like, and movement of the inkjet recording head in the direction orthogonal to the conveying direction of the recording medium (main scanning) and movement of the recording medium (subscanning) are carried out alternately.

Generally, in an inkjet recording device, there is the need to carry out restoring operations on the nozzles, such as, for example, carrying out so-called dummy jetting so as to eliminate clogging of the nozzles, capping the peripheries of the nozzles to prevent the thickening which accompanies drying of the ink, and the like. Therefore, a head restoring unit (sometimes called a maintenance device or a maintenance unit or the like) is provided within the inkjet recording device, and carries out these restoring operations.

In the above-described scanning inkjet recording device, it is easy to withdraw the inkjet recording head to a position at which it does not face a recording medium conveying unit (conveying rollers or spurs or the like). Thus, there has not been any particular difficulty in providing the head restoring unit at this withdrawn position and carrying out the head restoring operations.

Further, because inkjet recording heads can be made to be compact (a single nozzle at a single inkjet recording head suffices as the minimum necessary structure), the yield in the production of inkjet recording heads is high.

However, on the other hand, because reciprocal movement of the inkjet recording head (main scanning) at the time of image recording is essential, limits to the pursuit of high produceability (carrying out image recording on more recording media per unit time) arise as a matter of course.

Thus, in order to realize high produceability, a so-called full-line-head-type inkjet recording device has been proposed in which an elongated inkjet recording head, which can carry out image recording all at once over a region which is the same as or larger than the width of the recording medium (the length of the recording medium in the direction orthogonal to the conveying direction), is fixed, and image recording of the entire image is carried out only by conveying the recording medium. In this method, because there is no need for reciprocal operation of the inkjet recording head, high produceability can be achieved as compared with a scanning inkjet recording device.

However, an inkjet recording head of a size which is larger than the width of the recording medium, i.e., a head having from several thousands to several tens of thousands of nozzles, must be manufactured as an integral part. Thus, there are cases in which the yield is poor.

Further, in the full-line-head-type inkjet recording device, there is the need for new measures in order to mount the aforementioned head restoring unit.

For example, Japanese Patent Application Laid-pen (JP-A) No. 8-132700 discloses a label printer structured so as to convey labels by plural conveying belts, and when the head restoring operation is carried out, the restoring unit is moved by a predetermined amount in the horizontal direction. Further, JP-A No. 2-179754 discloses an inkjet recording device in which a recording sheet is conveyed by a conveying belt, and a restoring system container is moved between a withdrawn position and a capping state. In structures such as these in which the head restoring unit is moved, it is not possible to carry out restoring operations (dummy jetting and the like) in continuation while image recording is being carried out, and there are limits to achieving high produceability.

Japanese Patent No. 2693224 discloses an inkjet recording device in which an opening, which is of a size which allows the discharging opening surface of an inkjet recording head to pass therethrough, is formed in a recording medium conveying belt. The head restoring device is placed in the conveying belt so as to oppose the inkjet recording head with the conveying belt therebetween. In this structure, when the inkjet recording head and the head restoring device oppose one another via the opening of the conveying belt, discharging of ink is carried out. Accordingly, dummy jetting is possible even while image recording is being carried out, and high produceability can be maintained. However, stress concentrates at the opening of the conveying belt, and there is the concern that this may lead to deformation or breakage of the conveying belt. Thus, it is difficult to carry out stable conveying of sheets over a long period of time. Further, the opening must be made to be larger than the opposing portion of the inkjet recording head, and a circumference of the conveying belt which takes the size of the recording medium into consideration is needed. Thus, it is difficult to make the structure compact.

JP-A No. 5-330030 discloses a recording device in which a recording head is disposed along the periphery of a cylindrical-tube-shaped suction cylinder, an opening is formed in the suction cylinder, and the opening can be opened and closed by a shutter. An absorbing body of a restoring system moves to the exterior of the suction cylinder via this opening, and abuts the discharging opening surface of the corresponding recording head. Therefore, dummy jetting can be carried out during image recording. However, the suction cylinder must have an opening which is larger than the opposing portion of the recording head. Moreover, because the restoring system and the shutter must be provided within the suction cylinder, the suction cylinder becomes large.

SUMMARY OF THE INVENTION

The present invention has been made in view of the above circumstances to provide an inkjet recording device in which produceability is high, and in which head restoring operations can be carried out even during image recording, and which is simple and compact.

In accordance with a first aspect of the present invention, there is provided an inkjet recording device having: a conveying unit for conveying a recording medium in a predetermined conveying direction; plural recording head groups each structured by plural unit heads which are provided along the conveying direction and whose ink discharging characteristics are different, the recording head groups corresponding respectively to plural individual recording regions which are divided in a recording medium transverse direction which is orthogonal to the conveying direction, the recording head groups at adjacent individual recording regions being disposed at respectively different positions along the conveying direction, and the recording head groups discharging ink drops from the unit heads onto the recording medium; and an ink receiving unit disposed so as to face ink drop discharging surfaces of the unit heads, for at least receiving ink discharged from the unit heads, wherein the conveying unit is a plurality of conveying belts which are disposed at positions evading trajectories of the ink drops from the unit heads as seen in a direction of a line normal to the recording medium, and which are disposed so as to be divided in the conveying direction.

In accordance with a second aspect of the present invention, there is provided an inkjet recording device having: a plurality of conveying belts conveying a recording medium in a predetermined conveying direction; a conveying belt driving system having a plurality of roller members around which the conveying belts are trained, and one of the plurality of roller members is a drive roller, and other roller members are slave rollers, and the drive roller is connected to a rotation drive source; a plurality of recording head groups respectively structured by a plurality of unit heads which are disposed along the conveying direction and have different ink discharging characteristics, the recording head groups discharging ink drops from the unit heads with respect to the recording medium; and the ink receiving unit, disposed so as to oppose ink drop discharging surfaces of the unit heads, for receiving ink discharged from the unit heads, wherein the plurality of recording head groups are, at adjacent individual recording regions of a plurality of individual recording regions which are sectioned off in a recording medium transverse direction which is orthogonal to the conveying direction, disposed so as to be at respectively different positions along the conveying direction in correspondence with the respective individual recording regions, and the conveying belts are disposed at positions which evade trajectories of ink drops from the unit heads when seen from a direction of a line normal to the recording medium, and are divided into sections in the conveying direction, and a plurality of the conveying belts are disposed at each section.

Because the present invention has the above-described structure, the produceability is high, head restoring operations can be carried out even during image recording, and the inkjet recording device can be made to be compact.

BRIEF DESCRIPTION OF THE DRAWINGS

Preferred embodiment(s) of the present invention will be described in detail based on the following figures, wherein.

DETAILED DESCRIPTION OF THE INVENTION

The schematic structure of an inkjet recording device 12 of a first embodiment of the present invention is shown in FIGS. 1 through 3.

Figure 1A:
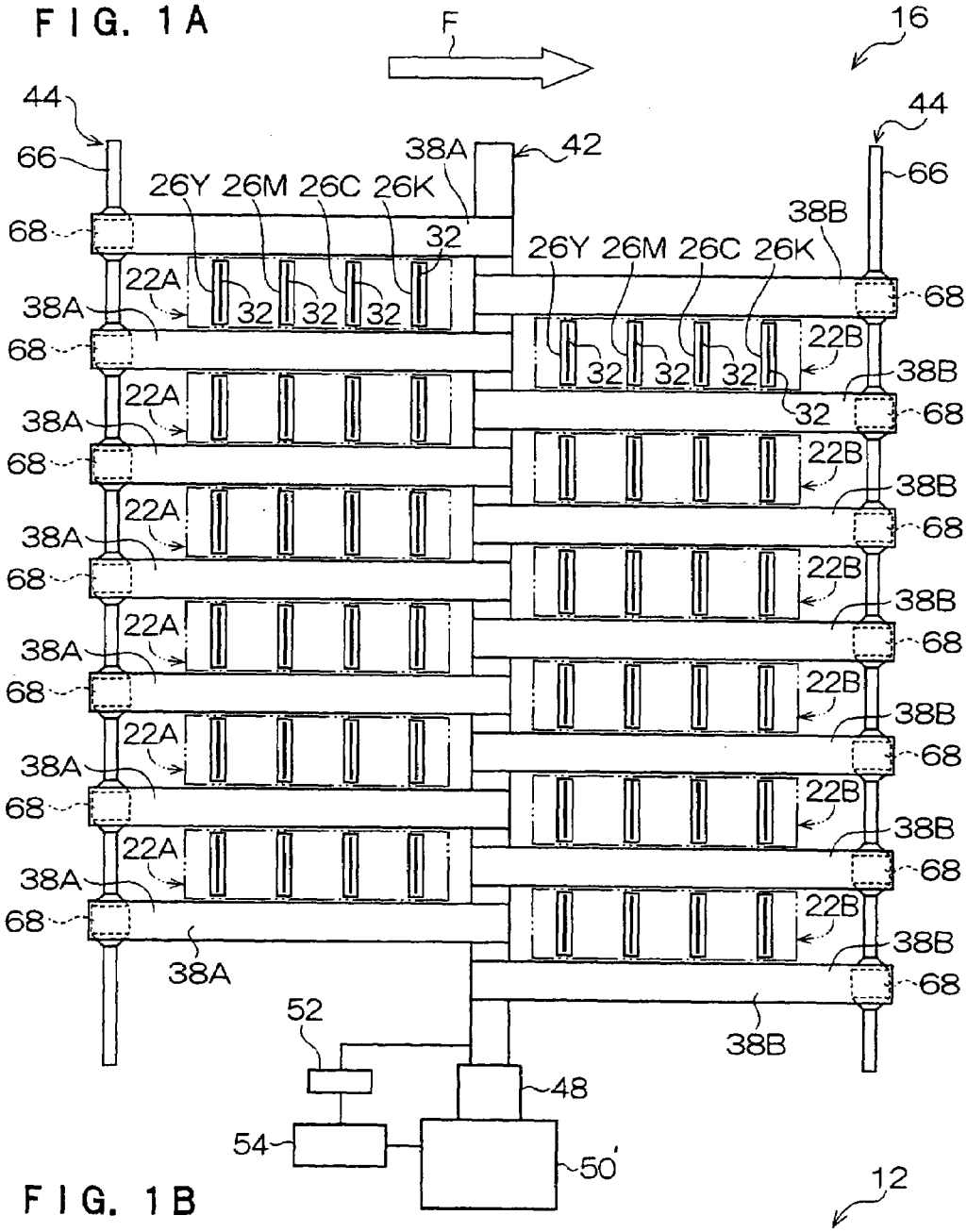
FIG. 1A is a plan view showing the schematic structure of an inkjet recording device of a first embodiment of the present invention.
Figure 1B:
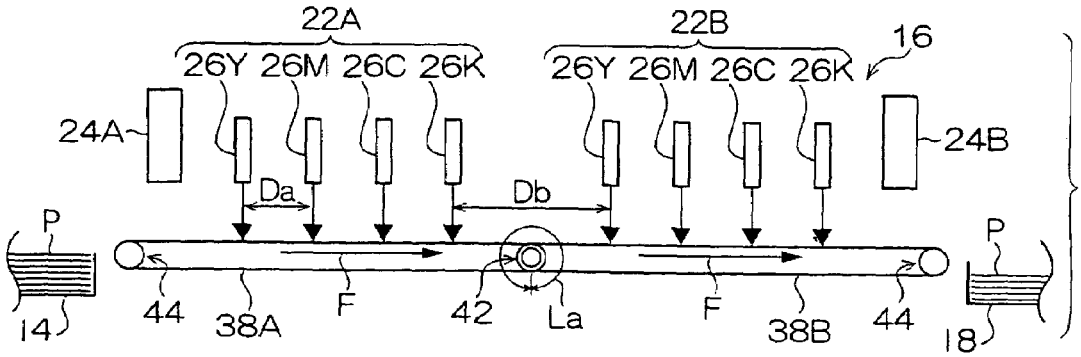
FIG. 1B is a front view of the schematic structure shown in FIG. 1A.

As shown in FIG. 1B, the inkjet recording device 12 has a sheet feeding tray 14 in which sheets P, which are one example of a recording medium, are accommodated; a recording section 16 recording images onto the sheets P supplied from the sheet feeding tray 14; and a sheet discharge tray 18 accommodating the sheets P on which images have been formed by the recording section 16. The sheets P in the sheet feeding tray 14 are removed one-by-one by a pick-up roller (not shown), and fed to the recording section 16.

As shown in FIG. 3, the recording section 16 has a frame-shaped sheet conveying frame 20 which is mounted to a housing (not shown). The sheet P is conveyed in a predetermined conveying direction on the sheet conveying frame 20. In the respective drawings, the sheet conveying direction is denoted by arrow F, and the sheet transverse direction, which is orthogonal thereto, is denoted by arrow W.

Figure 2A:
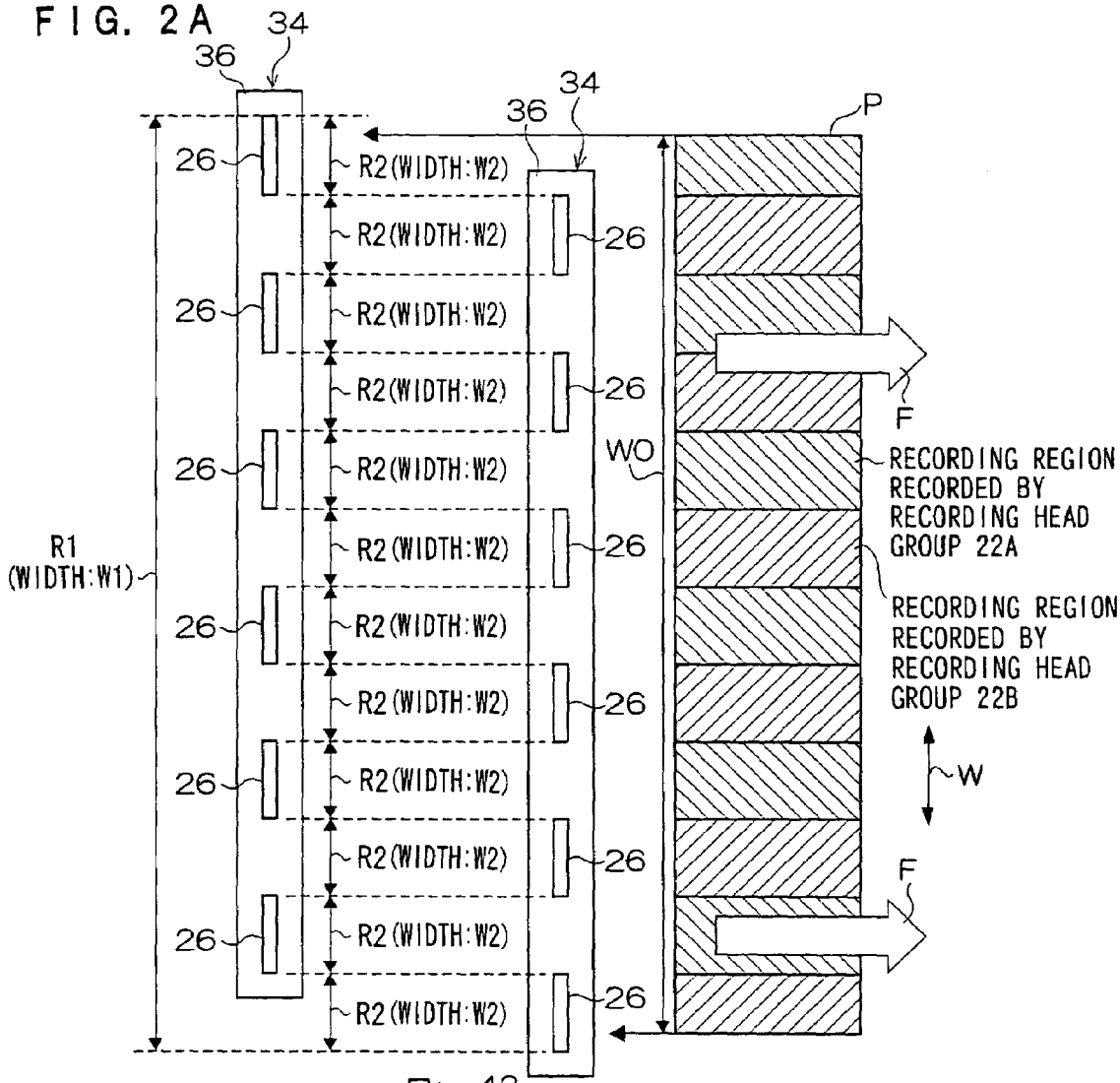
FIG. 2A is an explanatory drawing showing the relationship between recording head arrays and a sheet width and a recordable region, of the inkjet recording device relating to the first embodiment of the present invention.

As shown in FIG. 2A, the recording section 16 has a recordable region R1 of a width W1 which is about the same as or is wider than a maximum width W0 of the sheet P for which image recording in the inkjet recording device 12 is assumed. For example, when an A3 size sheet is assumed, the maximum width W0 thereof is 297 mm, whereas the width W1 of the recordable region R1 is made to be 304.8 mm in the present embodiment as will be described later.

A plurality of individual recording regions R2, which are sectioned off in the transverse direction of the sheet P, are assumed at the recordable region R1. As can be understood from FIG. 1, a recording head group 22 of the present invention is disposed so as to correspond to each of the individual recording regions R2. The recording head groups 22 are disposed in a so-called staggered fashion. Recording head groups 22 which are adjacent to one another in the sheet transverse direction are positioned alternately in the conveying direction. (Hereinafter, when there is the need to distinguish the recording head groups 22 at the upstream side and those at the downstream side in the conveying direction, the upstream side groups will be indicated as recording head groups 22A, and the downstream side groups will be indicated as recording head groups 22B.) Accordingly, regions recorded by the recording head groups 22A and regions recorded by the recording head groups 22B are lined up alternately in the sheet transverse direction on the sheet P for which image recording has been completed.

As shown in FIG. 1B, sheet sensors 24A, 24B are disposed at the upstream side of the recording head groups 22A and at the downstream side of the recording head groups 22B. Each of the sheet sensors 24A, 24B detects the sheet P, and transmits that information to a controller.

Each of the recording head groups 22 is structured by plural unit heads 26, which have different ink discharging characteristics, being lined-up along the sheet conveying direction.

Figure 4:
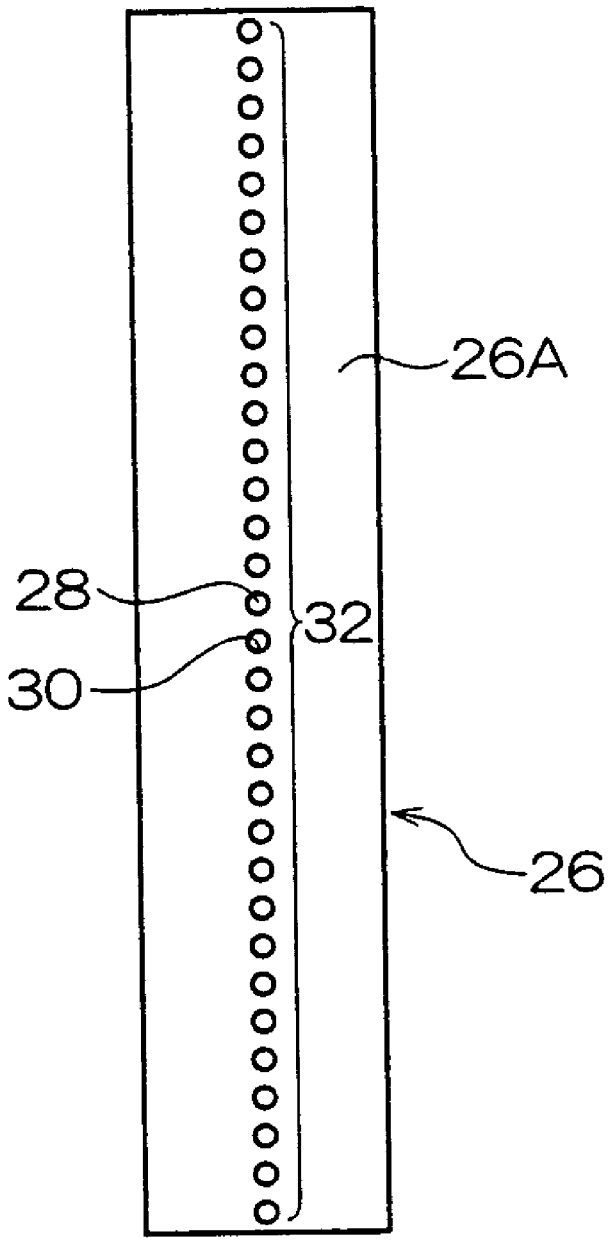
FIG. 4 is an explanatory drawing showing a unit head of the inkjet recording device of the present invention from an ink discharging surface side.

As shown in FIG. 4, a nozzle row 32 is structured at the unit head 26 by plural nozzles 28 which are formed along the sheet transverse direction. Ink drops corresponding to image information can be discharged from ink discharging openings 30 of the distal ends of the nozzles 28. As can be understood from FIG. 1A, within one recording head group 22, the respective unit heads 26 are arranged such that the positions of the both ends of the nozzle rows 32 coincide in the sheet transverse direction. Further, as seen in the sheet conveying direction, the recording head groups 22A and the recording head groups 22B are disposed so as to coincide or so as to overlap in the sheet transverse direction, such that no intervals arise between the dots on the sheet P which are formed by the ink drops discharged from the respective unit heads 26. Accordingly, each recording head group 22 records an image on the sheet P only at the corresponding individual recording region R2, and recording of an image extending over the entire width of the sheet P is possible by all of the recording head groups 22. Note that, in a case in which the unit heads 26 are disposed such that the dots from the respective unit heads 26 overlap in the sheet transverse direction, it suffices to not use the nozzles 28 corresponding to the overlapping portions.

The aforementioned "ink discharging characteristic" means the characteristic of the discharged ink drop, and, for example, the color or the drop volume of the ink drop, the discharging speed, and the like are included therein. In the present embodiment, there are four unit heads 26 per recording unit group 22, and the respective colors of yellow (Y), magenta (M), cyan (C), and black (K) are allotted thereto in that order from the conveying direction upstream side. In this way, it is possible to record a so-called full-color image. (Hereinafter, when there is the need to distinguish the unit heads 26 per color, they will be distinguished by adding one of Y, M, C, and K to the end of the reference numeral.) Structures other than this may of course be used. For example, even if there are two of the unit heads 26 per recording head group 22, a two-color image can be recorded by assigning different colors to the respective unit heads 26. Further, a structure is possible in which colors other than YMCK are added by making the number of unit heads 26 per recording head group 22 be, for example, 5 or more, such that the color reproduceability is better. Moreover, even for unit heads 26 corresponding to the same color, the volumes of the ink drops may be made to be different, so as to achieve a higher gradation.

The recording head group 22 may be structured by the plural unit heads 26 being formed integrally as a unit within one recording head group 22. However, in the present embodiment, as shown in FIG. 2A, at each of the recording head groups 22A, 22B, a common substrate 36 is provided for the unit heads 26 corresponding to each color. By structuring a recording head unit 34 by mounting the unit heads 26 to the common substrate 36, the assembly of the units heads 26 can be carried out easily. (Note that, in FIG. 2 (as well as in FIG. 8 which will be described later), for convenience in the drawings, only the recording head unit 34 corresponding to a specific color (e.g., yellow) is illustrated, but the same holds for the other colors as well.) Namely, the recording unit 34 is structured by spanning the common substrate 36 across in the recording medium transverse direction, fixing the common substrate 36 to an unillustrated housing (or member for fixing), and mounting the plural unit heads 26 to the common substrate 36 at uniform intervals in the sheet transverse direction (intervals which are the same as the width W2 of the individual recording regions R2). In this way, the recording head groups 22A overall have one recording head unit 34 for each of the colors. (In the present embodiment, the recording head groups 22A have a total of four of the recording head units 34.) Similarly, the recording head groups 22B overall have one recording head unit 34 for each of the colors (for a total of four recording head units 34). At each of the recording head units 34, the unit heads 26 are mounted at intervals that are the same as the width W2 of the individual recording regions R2. Therefore, two of the recording head units 34 which correspond to the same color have exactly the same structure. By disposing these two recording head units 34 so as to be offset, along the sheet transverse direction, by the width W2 of the individual recording regions R2, it is possible to discharge ink drops over the entire width of the sheet P. By using the recording head unit 34 in common in this way, the number of parts can be reduced, and the recording section 16 can be structured at a low cost.

Note that, in the present embodiment, the length of the nozzle row 32 of the unit head 26 is 25.4 mm. Six of the unit heads 26 are provided at one recording head unit 34.

Moreover, two of the recording head units 34 are provided for each color. Therefore, on the whole, the 25.4 mm nozzle rows 32 are lined up without intervals therebetween as seen in the sheet transverse direction, and a width of 304.8 mm is obtained for the recordable region R1.

As shown in FIG. 1A, medium conveying belts 38 are disposed at the regions, in the recordable region R1, where ink drops are not discharged from the recording head groups 22 (the unit heads 26) (hereinafter called "non-recording regions"), i.e., at positions evading the trajectories of the ink discharged from the unit heads 26. Because the non-recording regions are disposed alternately with the recording head groups 22 along the sheet transverse direction, the plural medium conveying belts 38 are provided at uniform intervals in the sheet transverse direction. Because upstream side medium conveying belts 38A and downstream side medium conveying belts 38B are disposed so as to be offset, in the sheet transverse direction, by the width of the individual recording regions R2, the medium conveying belts 38 are disposed in a staggered manner overall.

Accordingly, in the present embodiment, when viewing the recordable region R1 in the sheet transverse direction, the recording head groups 22A and the recording head groups 22B are respectively disposed at uniform periods at the individual recording regions R2, the medium conveying belts 38A and the medium conveying belts 38B are disposed at uniform periods at the non-recording regions, and the recording head groups 22 and the medium conveying belts 38 are disposed alternately.

The medium conveying belts 38 convey the sheet P while circulating (rotating) in a predetermined direction while holding the sheet P due to friction with the sheet P or electrostatically or non-electrostatically. Examples of non-electrostatic holding methods include suction, adhesion, and the like.

Figure 3B:
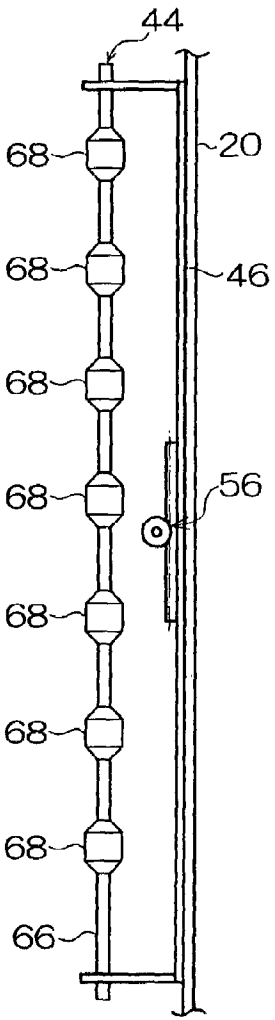
FIG. 3B is a side view showing a vicinity of a slave roller.
Figure 3A:
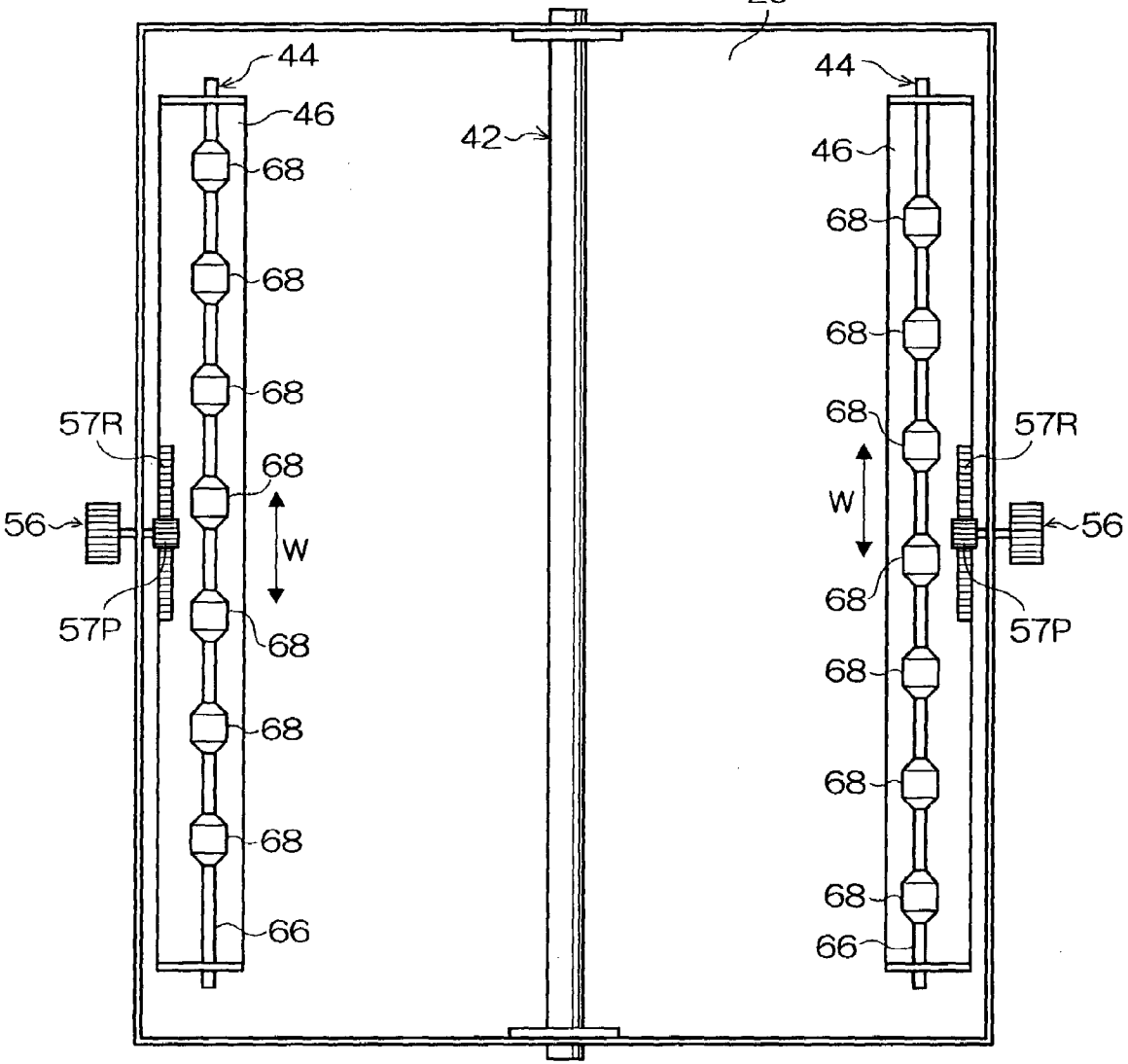
FIG. 3A is a plan view showing an interior of a sheet conveying frame of the inkjet recording device relating to the first embodiment of the present invention.

As shown in FIG. 3A as well, a single drive roller 42 spans across in the sheet transverse direction at the center, in the sheet conveying direction, of the recording section 16, and is supported rotatably at the sheet conveying frame 20. The upstream side medium conveying belts 38A and the downstream side medium conveying belts 38B are alternately trained around and held at the drive roller 42.

A single slave roller 44 spans across in the sheet transverse direction at each of a vicinity of the upstream end and a vicinity of the downstream end in the sheet conveying direction. The slave rollers 44 are rotatably supported via bearings or the like at slave roller frames 46 within the sheet conveying frame 20. As shown in FIG. 1A, the medium conveying belts 38A and the medium conveying belts 38B are trained around and held by the corresponding slave roller 44.

The drive roller 42 is connected to a drive motor 50 via a gear 48 (or is directly connected thereto). The drive motor 50 is the drive source of the medium conveying belts 38. Due to the drive roller 42 rotating due to the driving of the drive motor 50, all of the medium conveying belts 38 can be made to circulate at the same circulating speed. Therefore, nonuniform quality among the images recorded at the recording head groups 22A, 22B can be eliminated, and a high-quality image can be obtained. Note that it is preferable to use a stepping motor as the drive motor 50 because highly-accurate sheet conveying control is possible. However, the drive motor 50 is not limited to a stepping motor.

An encoder 52 is provided at the drive roller 42, and outputs a predetermined pulse synchronously with the rotation of the drive roller 42. On the basis of this pulse, a drive motor controlling unit 54 controls the rotation of the drive motor 50, and can keep, to within a fixed range, the non-uniformity of the rotation of the drive roller 42 which is caused by, for example, eccentricity of the output shaft of the drive motor 50, the gear 48, the drive roller 42, or the like.

Note that the drive motor control unit 54 is not limited provided that it can carry out the aforementioned control. For example, it is possible to use a structure which carries out eccentricity control by reading the difference with the ideal rotation of the drive roller 42, i.e., the eccentricity error component, from the individual encoder signals at the time when the drive roller 42 rotates, and to provide information which cancels the eccentricity error component to the drive motor 50.

As shown in FIGS. 3A and 3B, the slave roller frames 46 which support the slave rollers 44 are mounted to the sheet conveying frame 20 so as to be able to move in the axial direction of the slave rollers 44. Knobs 56, which are rotated manually, are provided at the sheet conveying frame 20. A pinion 57P, which is coaxial with the knob 56, meshes together with a rack 57R of the slave roller frame 46. Thus, the slave roller 44 can be moved in the axial direction by rotating the knob 56. In this way, because the errors of the medium conveying belts 38 in the direction of circulation of the belts can be made to be small, the sheet P is conveyed at the correct position, and a high-quality image can be obtained.

Figure 5A:
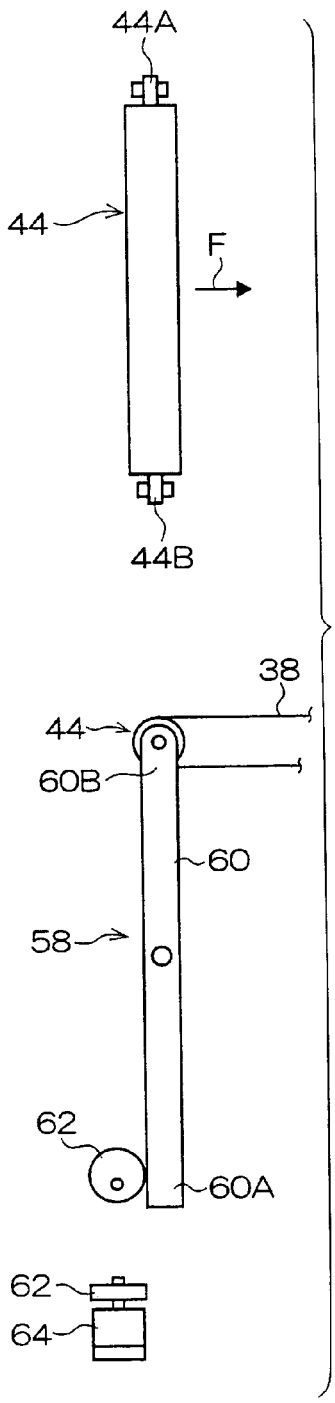
FIG. 5A shows a steering mechanism of the slave roller in the inkjet recording device of the first embodiment of the present invention, and shows a state in which the slave roller coincides with the sheet transverse direction.
Figure 5B:
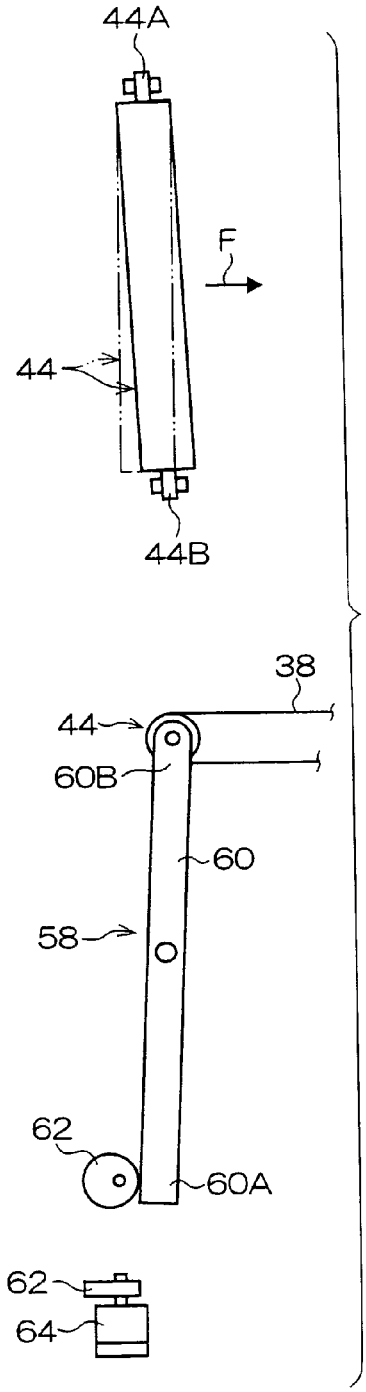
FIGS. 5B and 5C respectively show states in which the slave roller is inclined with respect to the sheet transverse direction.
Figure 5C:
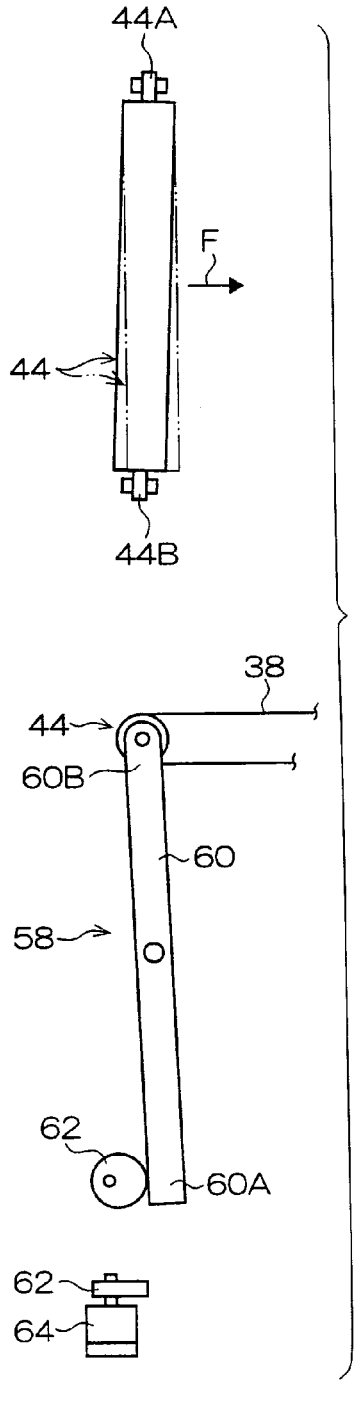

As shown in FIGS. 5A, 5B, and 5C, one end 44A of the slave roller 44 is immobile in the sheet conveying direction, and another end 44B is movable in the sheet conveying direction, and a steering mechanism 58 is provided. The steering mechanism 58 is structured by a swinging arm 60 which can swing with the central portion thereof being the center of swinging; an eccentric cam 62 disposed so as to contact one end 60A side of the swinging arm 60; and a motor 64 which rotates the eccentric cam 62. Another end 60B of the swinging arm 60 holds the other end of the slave roller 44. By rotating the motor and setting the eccentric cam 62 at a predetermined rotational angle, the swinging arm 60 is swung, and the slave roller 44 can be moved from the posture parallel to the sheet transverse direction as illustrated in FIG. 5A, to, as shown in FIGS. 5B and 5C, postures which are inclined in the sheet conveying direction. In this way, skewed conveying of the sheet P which is being conveyed on the medium conveying belts 38 can be prevented. Adjustment of the amount of swinging of the slave roller 44 by the steering mechanism 58 can be carried out by, for example, providing an edge sensor which detects the position of the other end 44B of the slave roller 44, and carrying out the adjustment on the basis of the positional information from the edge sensor.

Note that, in FIG. 1A, the drive roller 42 is structured by a solid cylindrical or a hollow cylindrical member having a uniform diameter along the axial direction thereof. Further, the slave roller 44 is structured by a shaft 66 and plural pulleys 68 which are fixed to the shaft 66. In this way, all of the medium conveying belts 38 are disposed along the sheet conveying direction, and are parallel.

Figure 6A:
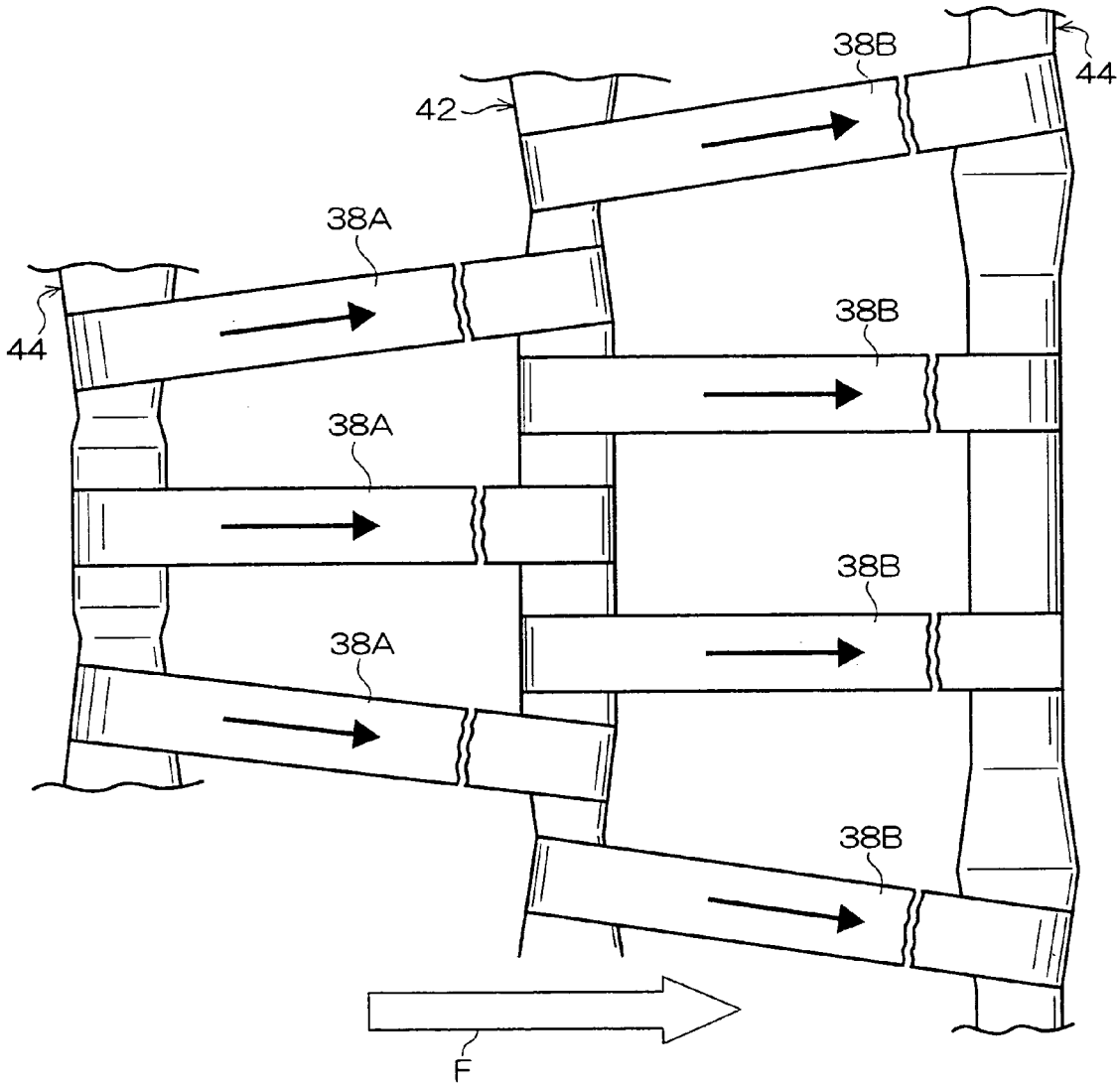
FIG. 6A is an explanatory drawing of a variation of the medium conveying belts of the inkjet recording device of the present invention.

In contrast, the medium conveying belts 38 may be held so as to be in the postures shown in FIG. 6A. In this example, the drive roller 42 and the slave rollers 44 do not have the pulleys 68, and are structured only by shafts. The portions thereof around which the medium conveying belts 38 are trained are inclined at respective predetermined angles with respect to the sheet transverse direction. In this way, as compared with the medium conveying belts 38A, 38B at the center in the sheet transverse direction, the medium conveying belts 38A, 38B at the end portions are set in postures so as to spread outwardly the further toward the conveying direction downstream side. Setting the medium conveying belts 38A, 38B in such postures is preferable in that wrinkles and slack in the sheet P during conveying can be prevented, and deterioration in image quality caused thereby, such as offset of the image recording positions or the like, can also be prevented.

Figure 6B:
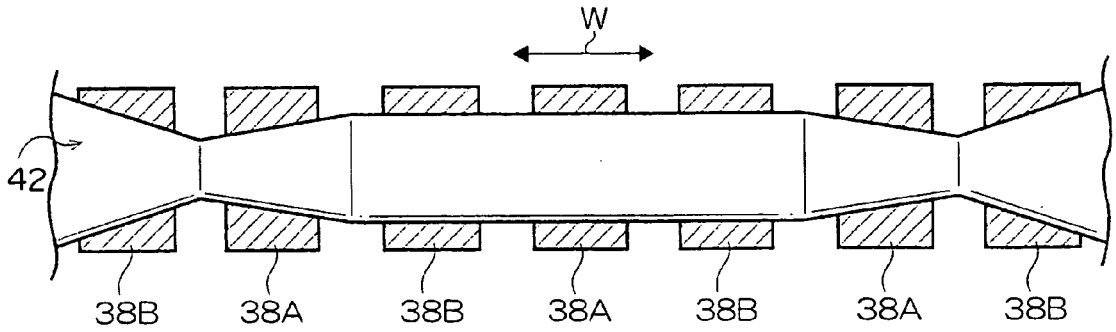
FIG. 6B shows the medium conveying belts of FIG. 6A in a sectional view.

In this structure, as can be understood from FIG. 6B, it is preferable to form the respective medium conveying belts 38A, 38B in configurations having different thicknesses in the widthwise direction in correspondence with the inclinations of the train-around portions of the slave rollers 42, so as to ensure the flatness of the top surfaces, i.e., the surfaces conveying the sheet P, when the medium conveying belts 38A, 38B are viewed on the whole.

Figure 7:
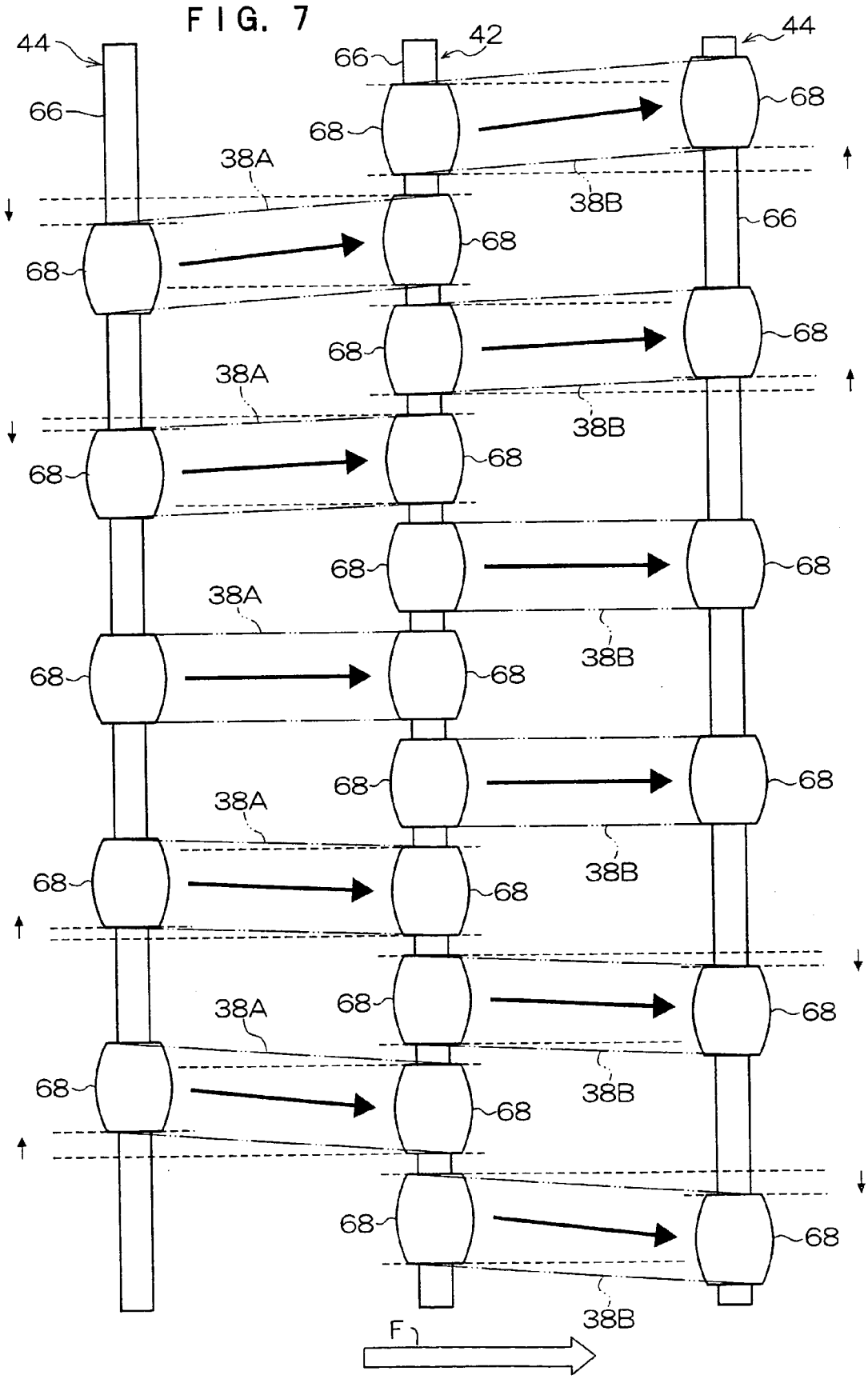
FIG. 7 is an explanatory drawing of a variation of the medium conveying belts of the inkjet recording device of the present invention.

Note that the structure shown in FIG. 7 may be used for example, in order to set the medium conveying belts 38A, 38B at postures so as to spread outwardly the further toward the conveying direction downstream side. In this example, both the drive roller 42 and the slave rollers 44 are structured by the shaft 66 and the pulleys 68. The pulleys 68 are formed in a barrel-shape (a crown-shape) whose axial direction center is convex outwardly. The pulleys 68 of the slave rollers 44 are respectively disposed so as to be slightly offset in the axial direction more so than the pulleys 68 of the drive roller 42, such that the medium conveying belts 38A, 38B are configured so as to spread outwardly.

Or, wrinkles and slack in the sheet P at the time of conveying can be prevented also by the drive roller 42 and the slave rollers 44 having configurations such that the conveying speeds of the medium conveying belts 38A, 38B are faster at the sheet transverse direction end portions than at the sheet transverse direction center. For example, the diameters of the portions of the drive roller 42 and the slave rollers 44, around which portions the medium conveying belts are trained, may be made to increase gradually from the sheet transverse direction center toward the end portions.

As shown in FIG. 1B, a distance Da between nozzles in the sheet conveying direction between the respective unit heads 26 in the recording head group 22 is set to be n times (n is an arbitrary natural number) a circumference La of the drive roller 42. In this way, so-called color offset, which is caused by eccentricity of the drive roller 42, can be prevented.

Namely, generally, even when the drive roller 42 is mounted to the sheet conveying frame 20 with high accuracy, there are cases in which the drive roller 42 is eccentric, albeit slightly. Even if the drive roller 42 is rotated at a uniform angular speed, due to this eccentricity, cyclic fluctuations arise in the circulating speeds of the medium conveying belts 38, and the conveying speed of the sheet P also fluctuates cyclically. Accordingly, when the conveying speed of the sheet P is the fastest, the interval, in the sheet conveying direction, between the dots formed by the ink drops which are being discharged continuously widens, and when the conveying speed is the slowest, this interval narrows. For example, when a portion, where a yellow ink drop is discharged in the state in which the conveying speed is the fastest, is conveyed such that a magenta ink drop is discharged in the state in which the conveying speed is the slowest, a large amount of offset in the conveying direction arises between the yellow dot and the magenta dot. However, in the present embodiment, at an arbitrary place on the sheet P, the conveying speed at the time when the respective ink drops are discharged is the same for the respective colors. For example, at a place where a yellow ink drop is discharged in the state in which the conveying speed is the fastest, ink drops of the respective colors of magenta, cyan and black are discharged in the state in which the conveying speed is the fastest. Conversely, at a place where a yellow ink drop is discharged in a state in which the conveying speed is the slowest, the ink drops of the respective colors of magenta, cyan, and black are discharged in the same state in which the conveying speed is the slowest. In this way, color offset, which is caused by eccentricity of the drive roller 42, can be prevented.

Further, a distance Db between nozzles between the nozzles 28 of the downstream-most unit heads 26 of the recording head groups 22A and the nozzles 28 of the upstream-most unit heads 26 of the recording head groups 22B, similarly is set so as to be m times (m is an arbitrary natural number) the circumference La of the drive roller 42. In this way, in the same way as described above, even if the drive roller 42 is eccentric, offset of the dots formed by the ink drops from these two nozzles 28 is eliminated.

It suffices for the aforementioned distances Da, Db between nozzles to satisfy the respective aforementioned conditions, and it is not necessary for Da and Db to be equivalent. Further, although the distances Da, Db between nozzles are set so as to strictly be natural number multiples of the circumference La, in actuality, there are cases in which they are not strictly natural number multiples due to errors in assembly or the like. In these cases as well, it is preferable that the distances Da, Db between nozzles substantially be natural number intervals of the circumference La. Specifically, the distance Da between nozzles is preferably within the range of 0.8 n to 1.2 n, and is more preferably within the range of 0.95 n to 1.05 n, and is particularly preferably within the range of 0.99 n to 1.01 n. The same holds for the distance Db between nozzles.

Figure 2B:
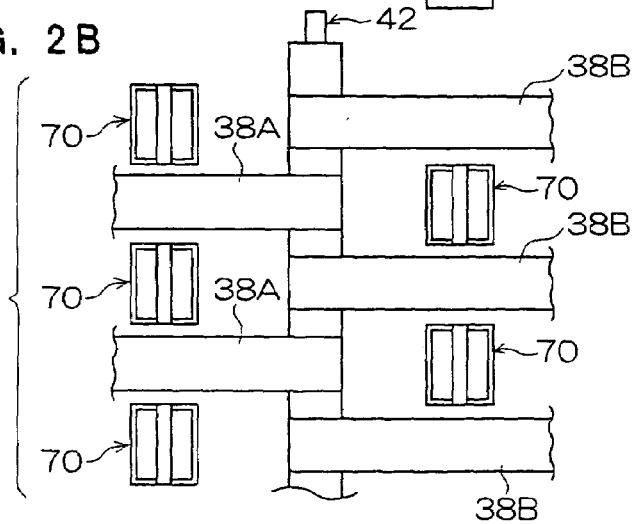
FIG. 2B is an explanatory drawing showing positions of medium conveying belts and head restoring units.

As shown in FIG. 2B and in FIGS. 8A through 8D, head restoring units 70, which correspond one-to-one to the unit heads 26, are disposed at positions facing the unit heads 26 with the sheet P, which is being conveyed, therebetween, i.e., at regions where the medium conveying belts 38A, 38B are not disposed. In the drawings, only one head restoring unit 70 is shown between the drive roller 42 and the slave roller 44, but in actuality, a number of head restoring units 70, which is equal to the number of unit heads 26, is provided. Further, in these drawings, the region between the upstream side slave roller 44 and the drive roller 42 is illustrated, but the head restoring units 70 are similarly provided also at the region between the drive roller 42 and the downstream side slave roller 44.

The head restoring unit 70 has at least a cap member 72 which is open toward the unit head 26, and a holding member 74 which holds the cap member 72. The holding member 74 is raised and lowered (is made to approach and move away from the unit head 26) by an unillustrated raising/lowering mechanism. A suction unit for suctioning the interior of the cap member 72 is provided as needed.

Figure 8A:
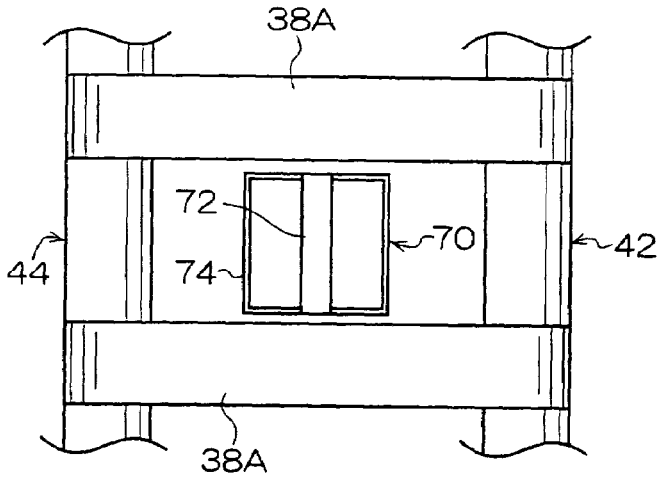
FIG. 8A is a plan view showing the head restoring unit of the inkjet recording device of the present invention.
Figure 8B:
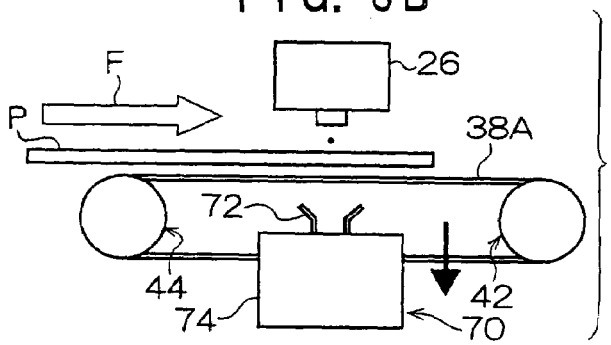
FIG. 8B is a front view showing the head restoring unit of the inkjet recording device of the present invention at the time of image recording.
Figure 8D:
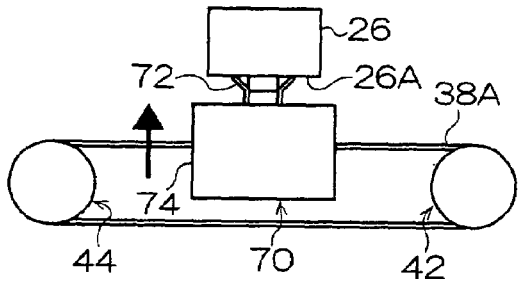
FIG. 8D is a front view showing the head restoring unit of the inkjet recording device of the present invention at the time of capping.

As shown in FIG. 8D, in the state in which the head restoring unit 70 is raised, the cap member 72 fits tightly to and caps an ink discharging surface 26A of the unit head 26 so as to surround the nozzle row 32 (see FIG. 4). In this way, needless drying of the ink is prevented, so as to prevent clogging of the nozzles 28 by thickened ink and prevent deterioration of the ink. Further, in this state, a so-called vacuum operation can be carried out so as to forcibly suction out ink from the nozzles 28 of the unit head 26.

Figure 8C:
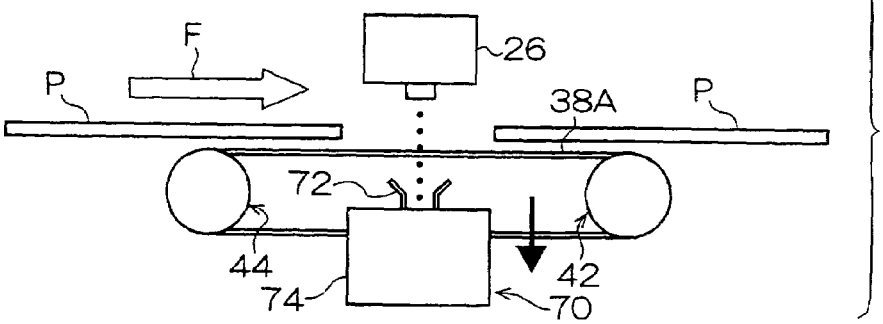
FIG. 8C is a front view showing the head restoring unit of the inkjet recording device of the present invention at the time of dummy jetting.

In contrast, in the state in which the head restoring units 70 are lowered, as shown in FIG. 8B, the sheet P is conveyed by the medium conveying belts 38A, 38B and can pass beneath the unit heads 26 such that image recording onto the sheet P can be carried out. Further, as shown in FIG. 8C, when the sheet P is not positioned beneath the unit heads 26 (e.g., between two consecutive sheets P), so-called dummy jetting is carried out from the unit heads 26, and these ink drops can be received at the cap members 72.

Note that a raising/lowering mechanism for the head restoring units 70 may be provided individually for each of the head restoring units 70, or may be provided in common for plural head restoring units 70. When a raising/lowering unit is used in common for plural head restoring units 70, for example, plural head restoring units 70 can be fixed to a common base plate, and the base plate itself can be raised and lowered.

Further, it is preferable that the head restoring unit 70 is able to carry out capping and the like of the unit head 26 as described above. However, depending on the structure of the inkjet recording device 12, there are cases in which it is sufficient for the head restoring units 70 to be able to at least receive the ink of the dummy jetting.

In the above description, the head restoring unit 70 functions as the ink receiving unit.

In the above description, the recording head groups 22A, 22B are disposed in a staggered manner overall. However, image recording over the entire width of the sheet P is possible if the recording head groups 22A, 22B are disposed so as to overall cover all of the individual recording regions. Therefore, the recording head groups 22A, 22B may be disposed randomly in the transverse direction of the sheet P. However, when, for example, the width and the like of the head restoring unit 70 are taken into consideration, if the recording head groups 22A, 22B are disposed at fixed periods in the transverse direction of the sheet P and spaces of a given extent are formed between the recording head groups 22A and between the recording head groups 22B respectively, even if the head restoring units 70 have wide widths, adjacent head restoring units 70 do not interfere with one another, and there are fewer constraints on the arrangement, which is preferable.

Similarly, it suffices for the sheet conveying belts 38A, 38B to be able to convey the sheet P reliably and to be at positions evading the trajectories of the ink drops from the unit heads 26, and the sheet conveying belts 38A, 38B also may be disposed randomly in the transverse direction of the sheet P. However, it is preferable that the sheet conveying belts 38A, 38B are disposed at fixed periods in the transverse direction of the sheet P and are able to convey the sheet P reliably.

In the inkjet recording device 12 which is structured as described above, an image is recorded onto the sheet P on the basis of a command from an unillustrated controller. Hereinafter, this image recording operation will be described.

In a state in which there is no command from the controller, the inkjet recording device 12 is in a standby state, and the respective members are stopped. The head restoring units 70 are raised, and the cap members 72 fit tightly to the ink discharging surfaces of the corresponding unit heads 26 and prevent clogging of the nozzles 28 and deterioration of the ink.

Figure 9:
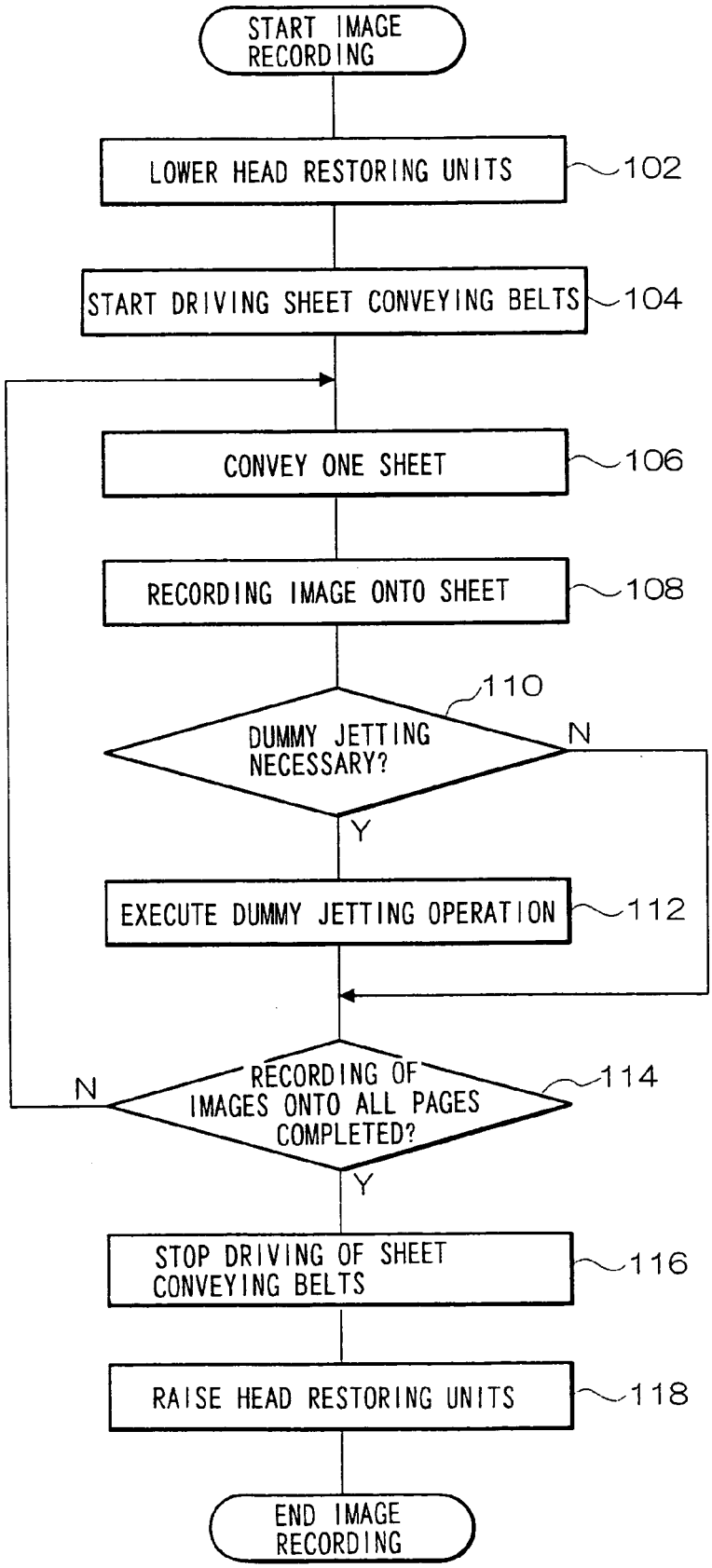
FIG. 9 is a flowchart showing the sequence of image recording in the inkjet recording device of the present invention.

When there is a command from the controller to carry out image recording, as shown in the flowchart in FIG. 9, first, in step 102, the inkjet recording device 12 lowers the head restoring unit 70, such that the sheet P can pass through beneath the unit heads 26.

At this time, as needed, so-called dummy jetting may be carried out, and the unit heads 26 may be restored to states optimal for ink drop discharging. Because the cap members 72 are positioned beneath the unit heads 26, the cap members 72 can receive the ink drops discharged by the dummy jetting.

In accordance therewith, in step 104, the drive motor 50 is driven, the drive roller 42 is rotated, and the medium conveying belts 38A, 38B are driven to circulate. At this time, the drive motor 50 is rotated while signals from the encoder 52 are received and eccentricity control is carried out. In this way, in a state in which the circulating speeds of the medium conveying belts 38A, 38B are stabilized, the controller drives the unillustrated pick-up roller in step 106, so as to feed the sheets P one-by-one from the sheet feeding tray 14 to the recording section 16.

When the sheet sensor 24A detects the leading end of the sheet P, in step 108, on the basis of this detection signal, the controller drives the respective unit heads 26 so that the unit heads 26 discharge ink drops at predetermined times which have been determined in advance. In this way, ink drops corresponding to image information are discharged onto predetermined positions of the sheet P successively from the upstream-most unit heads 26 in the conveying direction, and image recording is carried out. Because the conveying of the sheet P in this state is carried out by the medium conveying belts 38 which have predetermined widths in the sheet conveying direction and the sheet transverse direction, the sheet P can be conveyed stably.

At the point in time when the discharging of ink drops from the downstream-most unit heads 26 in the conveying direction is completed, image recording onto the entire sheet P is completed, and the sheet P is discharged out onto the sheet discharge tray 18. At this time, in step 110, a judgment is made as to whether dummy jetting is necessary. When dummy jetting is necessary, dummy jetting is carried out in step 112, and thereafter, the routine proceeds to step 114. If dummy jetting is not needed, the routine moves on as is to step 114. In step 114, the number of sheets P which have been discharged out is counted, and when image recording onto a predetermined number of sheets P has been completed, in step 116, rotation of the drive motor 50 is stopped, and circulation of the medium conveying belts 38A, 38B also is stopped. Note that the number of sheets P which have been discharged out may be known by the sheet sensor 24B detecting the trailing ends of the sheets P.

Thereafter, in step 118, the controller raises the head restoring units, and caps the respective unit heads 26 by the cap members 72.

In this way, the series of image recording operations is completed. Note that, in the state in which the unit heads 26 are capped by the cap members 72, suctioning (vacuuming) of ink from the unit heads 26 may be carried out as needed.

In this way, in the inkjet recording device 12 of the present embodiment, image recording over the entire width of the sheet P can be carried out by only conveying the sheet P and without moving the recording head groups 22A, 22B in the sheet transverse direction, and the produceability is good.

Further, the head restoring units 70 corresponding to the respective unit heads 26 always face the ink discharging surfaces 26A. When dummy jetting is carried out, there is no need to move the unit heads 26 or the head restoring units 70. Further, the medium conveying belts 38A, 38B are disposed at the non-recording regions, and the ink discharged during the dummy jetting does not needlessly adhere to the medium conveying belts 38A, 38B. Accordingly, while image recording is being carried out, dummy jetting also can be carried out at, for example, the regions between the sheets P. High produceability can be obtained with regard to this point as well. In addition, because there is no need to move the unit heads 26 or the head restoring units 70 at the time of dummy jetting, the structure of the inkjet recording device 12 can be made to be simple and compact.

Further, in the present embodiment, because the medium conveying belts 38A, 38B are used in conveying the sheet P in the recording section 16, the sheet P can be conveyed with high conveying accuracy while the flatness of the sheet P is ensured.

In particular, in the present embodiment, because the medium conveying belts 38A, 38B are disposed at fixed periods as seen in the transverse direction of the sheet P, the sheet P can be conveyed at an even higher conveying accuracy.

Note that, in the present invention, the arrangement of the recording head groups 22A, 22B, the arrangement of the medium conveying belts 38A, 38B, and the like are not limited to those described above, and the structures of the embodiments which will be described hereinafter can be employed. In the following description, only portions which differ from the first embodiment will be explained, and description of the same portions will be omitted. Further, in the drawings, the same reference numerals as in the first embodiment are applied to the same structural elements, members and the like as in the first embodiment, and detailed description is omitted.

Figure 10:
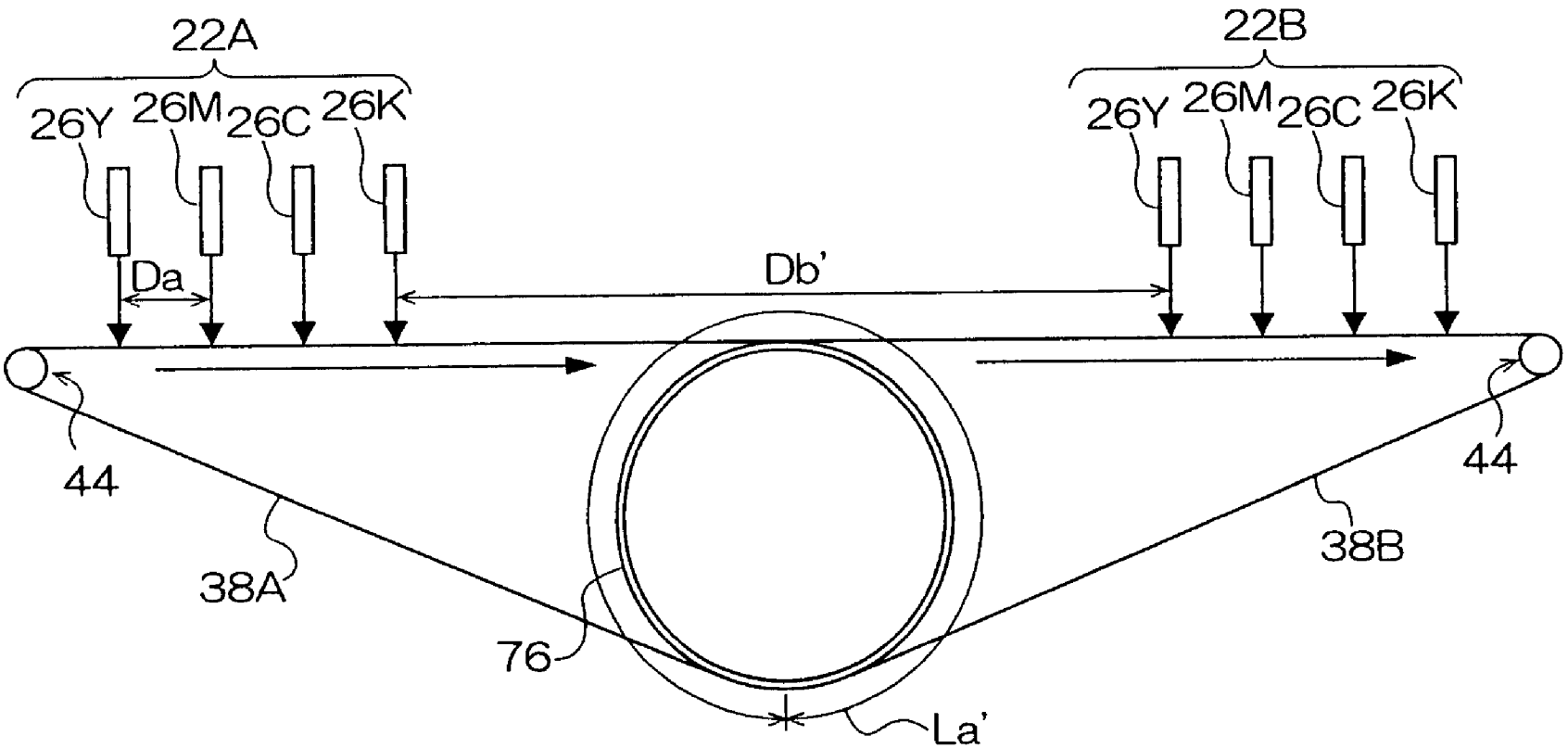
FIG. 10 is a front view showing the schematic structure of an inkjet recording device of a second embodiment of the present invention.

In the second embodiment illustrated in FIG. 10, as compared with the drive roller 42 of the first embodiment, a drive roller 76 having a larger diameter is used. A circumference La' of the drive roller 76 is sufficiently long as compared with the distance Da between nozzles between the unit heads 26 in the recording head group 22. In this way, even if the drive roller 76 is eccentric, color offset accompanying periodic fluctuations in the conveying speed caused thereby, and offset of the landing positions on the sheet P of the ink drops among the respective unit heads can be prevented. Namely, when looking at an arbitrary place on the sheet P, the difference between the conveying speed, at the time when ink drops are discharged from the unit head 26 of the recording head group 22A at this arbitrary place, and the conveying speed, at the time when ink drops are discharged from a different unit head 26 of the same recording head group 22A, is small. Therefore, offset in the landing positions on the sheet P of the dots formed by the ink drops from the respective unit heads 26 is small to the extent that it substantially does not cause any problems. For example, in a case in which the effect due to the eccentric error of the drive roller 42, i.e., the maximum value of the amount of change in position in the conveying direction per color of the ink drops discharged from the respective unit heads 26, is 100 μm, if the distance Da between nozzles within the recording head group 22 is kept to 1/10 or less of the circumference La', the error in the landing positions of the ink drops from adjacent unit heads 26 is 30 μm or less, and image quality of an extent which does not present any problems in practice can be obtained.

Note that, in the second embodiment as well, a distance Db' between nozzles of the unit heads 26 between the recording head groups 22A, 22B is preferably substantially a natural number multiple of the circumference La' of the drive roller 76.

Figure 11:
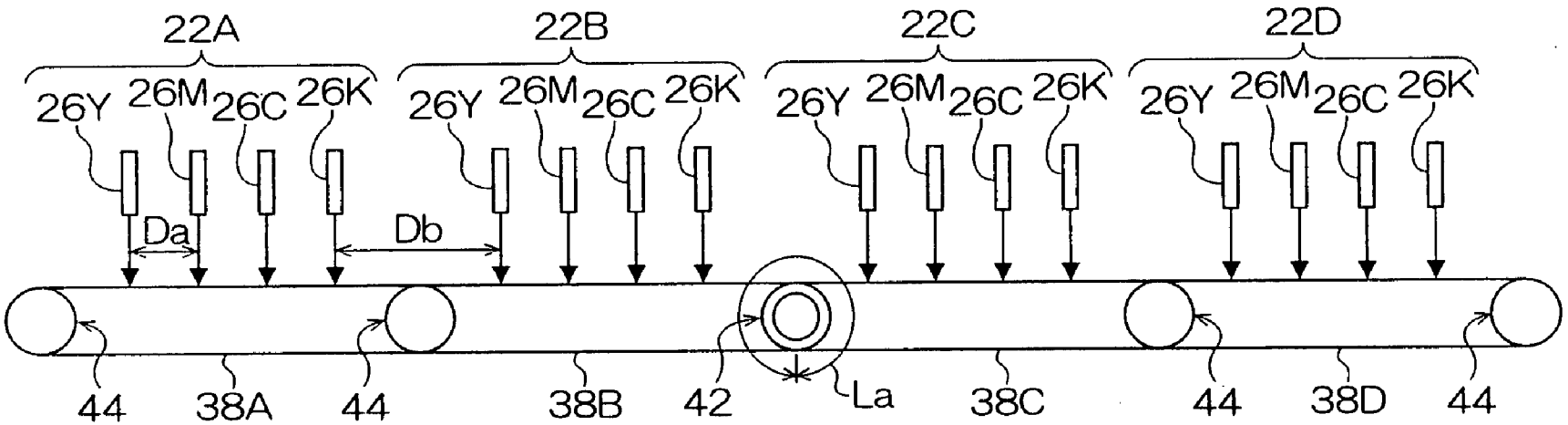
FIG. 11 is a front view showing the schematic structure of an inkjet recording device of a third embodiment of the present invention.

A third embodiment illustrated in FIG. 11 is structured to include, in addition to the recording head groups 22A, 22B, recording head groups 22C, 22D which are further downstream, such that there are four of the recording head groups 22. In correspondence therewith, there are four slave rollers 44, and four sheet conveying belts 38A, 38B, 38C, 38D are disposed in that order from the upstream side. Accordingly, as shown as an example in FIG. 12A, the arrangement of the recording head groups as seen in plan view repeats in the order of the recording head group 22A, the recording head group 22C, the recording head group 22B, and the recording head group 22D from the top side of the drawing.

Figure 12A:
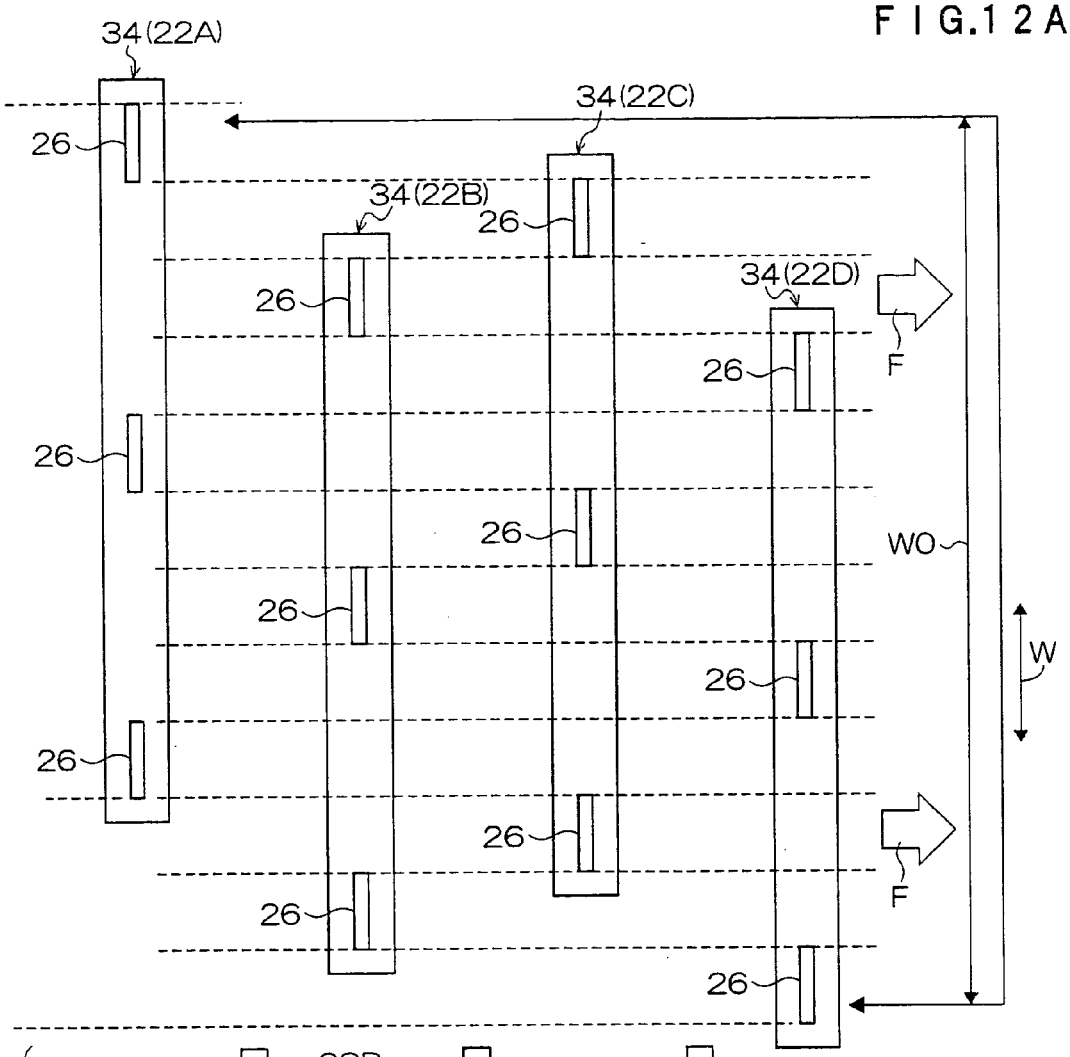
FIG. 12A is an explanatory drawing showing recording head arrays of the inkjet recording device of the third embodiment of the present invention.
Figure 12B:
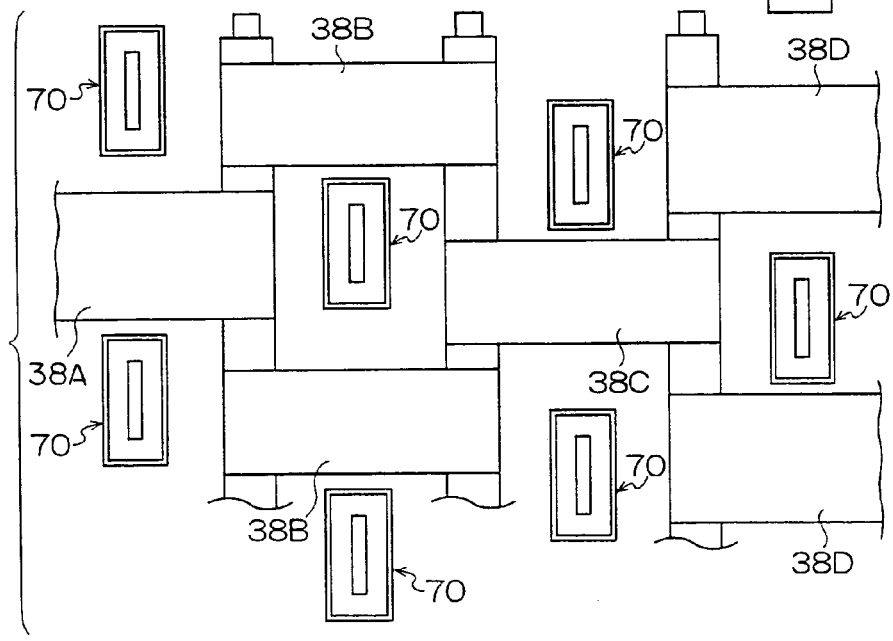
FIG. 12B is an explanatory drawing showing positions of medium conveying belts and head restoring units.

In this way, when there is a large number of recording head groups, as can be understood from FIGS. 12A and 12B, the interval between adjacent unit heads 26 in the sheet transverse direction within a single recording head unit 34 can be made to be greater than that in the first embodiment, and the widths of the medium conveying belts 38 can be made to be wider. Accordingly, in a case in which the physical size of the head restoring unit 70 (e.g., the cap member 72) is large, in a structure similar to that of the first embodiment, the widths of the medium conveying belts 38 must be made to be narrow, and there are cases in which the conveying capacity deteriorates. In contrast, in the present third embodiment, even in cases in which the physical size of the head restoring unit 70 is large, a sufficient conveying capacity can be obtained by making the widths of the medium conveying belts 38 wide as described above.

Note that it suffices for the widths of the medium conveying belts 38 to be wide to the extent that a sufficient conveying capacity can be obtained, and in accordance therewith, it suffices for the number of recording head groups 22 to be the needed number. Accordingly, three of the recording head groups 22, or five or more of the recording head groups 22 may be employed.

Figure 13:
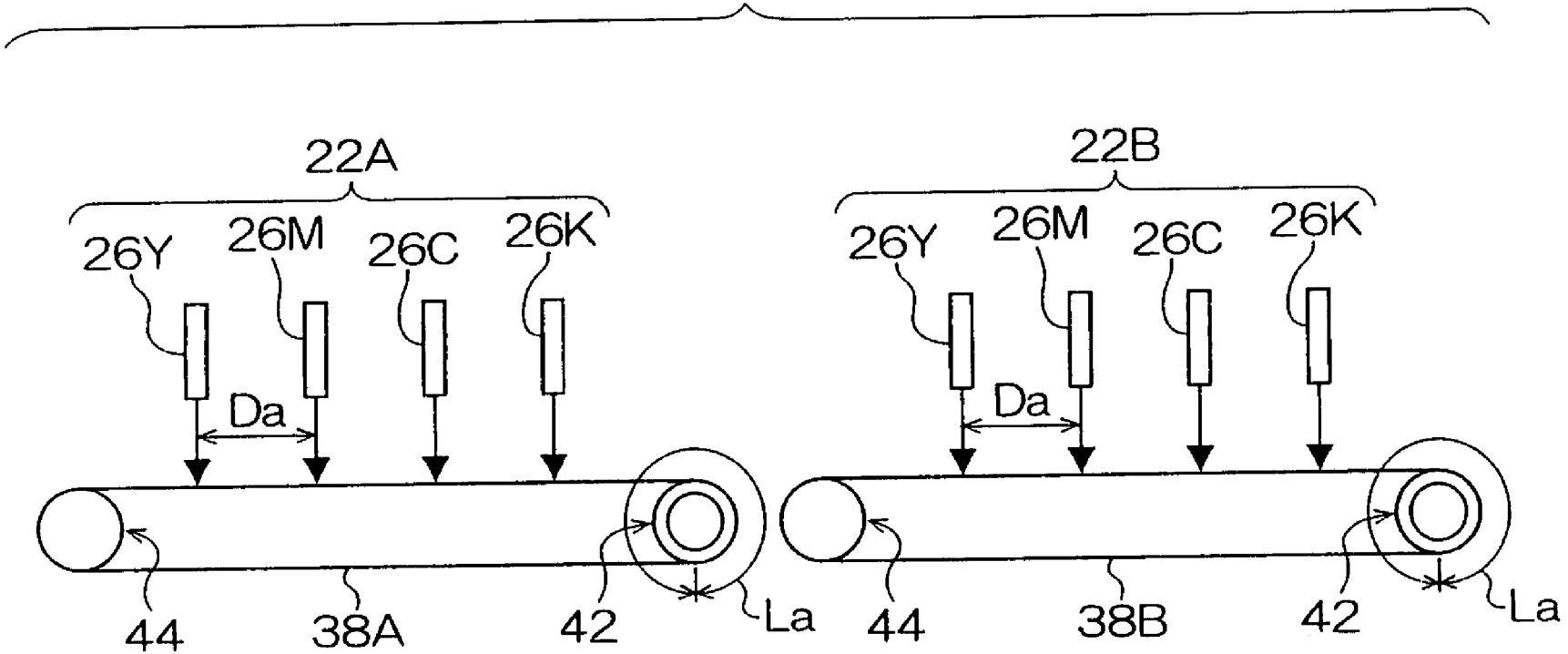
FIG. 13 is a front view showing the schematic structure of an inkjet recording device of the fourth embodiment of the present invention.

In a fourth embodiment shown in FIG. 13, the drive systems for the medium conveying belts 38A and for the medium conveying belts 38B are independent of one another. Namely, the drive roller 42 and the slave roller 44 are provided so as to correspond to the medium conveying belts 38A, and similarly, the drive roller 42 and the slave roller 44 are provided so as to correspond to the medium conveying belts 38B.

As can be understood from the above description, in the inkjet recording device of the present invention, the plural recording head groups are provided so as to correspond to the plural individual recording regions which are sectioned off in the recording medium transverse direction, such that the recording head groups can overall be made to correspond to the entire width of the recording medium. Accordingly, when a recording medium is conveyed by the conveying unit, image recording onto the entire width of the recording medium can be carried out. Because there is no need to move (main scan) the recording head groups, high produceability can be obtained. Because conveying belts are used as the conveying units, the recording medium can be conveyed at a high conveying accuracy while the flatness of the recording medium is maintained, and a high-quality image can be obtained.

The plural recording head groups are disposed so as to, at adjacent individual recording regions, be positioned at respectively different positions along the conveying direction. When viewed in the transverse direction of the recording medium, the recording head groups are apart from one another in the recording medium conveying direction. Further, a plurality of the conveying belts which are the conveying units are disposed in sections in the conveying direction, at positions evading the trajectories of the ink drops from the unit heads. Therefore, the ink drops do not adhere to the conveying belts at the time of image recording. Moreover, also when the ink from the unit heads is received at the ink receiving unit, the ink which flies does not adhere to the conveying belts. Accordingly, so-called dummy jetting can be carried out during image recording, and a high produceability can be obtained with respect to this point as well.

There is no need to move the ink receiving unit at the time of dummy jetting, and there is no need to provide openings in the conveying belts. Thus, the structure of the inkjet recording device can be made simple and compact.

A single recording head group has, along the conveying direction, plural unit heads which have different ink discharging characteristics. This "which have different ink discharging characteristics" widely covers the characteristics of the ink drops which are actually discharged being different, such as discharging ink drops of different colors, or ink drops of different drop volumes. Accordingly, as one example, recording of a so-called full-color image is possible if a single recording head group is structured by four (or more) unit heads and ink drops of at least yellow (Y), magenta (M), cyan (C) and black (K) can be discharged.

It is sufficient for the function of the ink receiving unit to be the ability to receive the ink which flies out due to the dummy jetting as described above. However, in addition, the ink receiving unit may be formed so as to be able to cap the ink discharging openings by fitting tightly to the ink discharging surface of the unit head.

In order to enable recording of the entire width of the recording medium, it suffices to provide the recording head groups at all of the individual recording regions. Therefore, the recording head groups may be disposed in a random arrangement in the recording medium transverse direction. However, disposing the recording head groups at fixed periods in the recording medium transverse direction is preferable.

Similarly, the arrangement of the conveying belts is not limited provided that they can reliably convey the recording medium and are located at positions evading the trajectories of the discharged ink drops. However, providing the conveying belts at fixed periods in the recording medium transverse direction is preferable in order to convey the recording medium more reliably.

Note that the inkjet recording device of the present invention includes a wide variety of devices, provided that they can record an image by discharging ink drops onto a recording medium. For example, recording devices used as output equipment such as fax machines, copiers, printer multifunction devices, work stations, and the like, are included. The ink jet recording method of the present invention as well encompasses recording methods of recording images onto recording media by these recording devices.

The "recording medium" which is the object of image recording in the inkjet recording device of the present invention includes a wide variety of objects, provided that they are objects onto which the inkjet recording device discharges ink drops. Further, patterns of dots on the recording medium, which are obtained by the ink drops adhering to the recording medium, are broadly included in the "image" or "recorded image" obtained by the inkjet recording device of the present invention. Accordingly, the inkjet recording device of the present invention is not limited to use in recording characters or images onto recording sheets. The recording medium of course includes recording sheets and OHP sheets and the like, but in addition thereto, also includes, for example, substrates on which wiring patterns or the like are formed, and the like. Further, "image" includes not only general images (characters, drawings, photographs, and the like), but also the aforementioned wiring patterns, as well as three-dimensional objects, organic thin films, and the like. The liquid which is discharged is not limited to a color ink. The inkjet recording device of the present invention can be applied to general liquid drop jetting devices used for various industrial applications such as, for example, the manufacturing of color filters for displays which is carried out by discharging color ink onto a polymer film or glass, the formation of bumps for parts packaging which is carried out by discharging solder in a molten state onto a substrate, the formation of EL display panels which is carried out by discharging an organic EL solution onto a substrate, the formation of bumps for electrical packaging which is carried out by discharging solder in a molten state onto a substrate, and the like.

While the present invention has been illustrated and described with respect to specific embodiments thereof, it is to be understood that the present invention is by no means limited thereto, and encompasses all changes and modifications which will become possible without departing from the scope of the appended claims.

What is claimed is:

1. An inkjet recording device comprising:

conveying units for conveying a recording medium in a predetermined conveying direction;

a plurality of recording head groups each structured by a plurality of unit heads which are provided along the conveying direction and whose ink discharging characteristics are different, the recording head groups corresponding respectively to a plurality of individual recording regions which are sectioned off in a recording medium transverse direction which is orthogonal to the conveying direction, the recording head groups at adjacent individual recording regions being disposed at respectively different positions along the conveying direction, and the recording head groups discharging ink drops from the unit heads onto the recording medium; and an ink receiving unit, disposed so as to face ink drop discharging surfaces of the unit heads, for at least receiving ink discharged from the unit heads, wherein the conveying unit is a plurality of conveying belts which are disposed at positions evading trajectories of the ink drops from the unit heads as seen in a direction of a line normal to the recording medium, and which are disposed so as to be divided in the conveying direction.

2. The inkjet recording device of claim 1, wherein the ink receiving unit fit tightly to the ink discharging surfaces of the unit heads and can cap ink discharge openings.

3. The inkjet recording device of claim 1, wherein the ink discharging characteristics are a color of the ink set for each unit head.

4. The inkjet recording device of claim 1, wherein the recording head groups are disposed at fixed periods along the recording medium transverse direction.

5. The inkjet recording device of claim 4, wherein the individual recording regions are set at uniform intervals along the recording medium transverse direction, and the inkjet recording device has recording head arrays disposed such that the unit heads are positioned at the individual recording regions at fixed periods along the recording medium transverse direction.

6. The inkjet recording device of claim 5, wherein the plurality of the recording head arrays are disposed so as to be offset in the recording medium transverse direction, by amounts corresponding to the individual recording regions.

7. The inkjet recording device of claim 1, wherein the conveying belts are disposed at fixed periods along the recording medium transverse direction.

8. The inkjet recording device of claim 1, further comprising a plurality of roller members around which the conveying belts are trained, wherein one of the roller members is a drive roller, and other roller members are slave rollers.

9. The inkjet recording device of claim 8, wherein the roller members are formed in configurations such that the conveying belts trained around the roller members spread out in the recording medium transverse direction toward a downstream side in the conveying direction.

10. The inkjet recording device of claim 8, further comprising swinging units for swinging the slave rollers in directions of extending the conveying belts.

11. The inkjet recording device of claim 8, further comprising moving units for moving the slave rollers in the recording medium transverse direction.

12. The inkjet recording device of claim 8, wherein a distance between nozzles of unit heads which are adjacent in the recording medium conveying direction at the recording head groups is substantially a natural number multiple of a circumference of the drive roller.

13. The inkjet recording device of claim 8, wherein a distance between nozzles of unit heads which are adjacent in the recording medium conveying direction at the recording head groups is substantially 1/10 or less than a circumference of the drive roller.

14. The inkjet recording device of claim 1, wherein the conveying belts are disposed so as to be segregated into a plurality of conveying belt groups along the conveying direction.

15. An inkjet recording method comprising:

recording images onto recording media by using the inkjet recording device of claim 1, wherein, while a plurality of recording media are being continuously conveyed in a predetermined conveying direction by the conveying units, dummy jetting is carried out between the recording media from arbitrary unit heads.

16. An inkjet recording device comprising:

a plurality of conveying belts conveying a recording medium in a predetermined conveying direction;

a conveying belt driving system having a plurality of roller members around which the conveying belts are trained, and one of the plurality of roller members is a drive roller, and other roller members are slave rollers, and the drive roller is connected to a rotation drive source;

a plurality of recording head groups respectively structured by a plurality of unit heads which are disposed along the conveying direction and have different ink discharging characteristics, the recording head groups discharging ink drops from the unit heads with respect to the recording medium; and an ink receiving unit, disposed so as to oppose ink drop discharging surfaces of the unit heads, for receiving ink discharged from the unit heads, wherein the plurality of recording head groups are, at adjacent individual recording regions of a plurality of individual recording regions which are sectioned off in a recording medium transverse direction which is orthogonal to the conveying direction, disposed so as to be at respectively different positions along the conveying direction in correspondence with the respective individual recording regions, and the conveying belts are disposed at positions which evade trajectories of ink drops from the unit heads when seen from a direction of a line normal to the recording medium, and are divided into sections in the conveying direction, and a plurality of the conveying belts are disposed at each section.

17. The inkjet recording device of claim 16, wherein a large diameter drive roller is disposed at an intermediate position between the slave rollers, one of the slave rollers being disposed at each of an upstream side and a downstream side as seen in the conveying direction of the recording medium.

18. The inkjet recording device of claim 16, further comprising conveying belt driving systems which independently drive the conveying belts of the respective sections.

* * * * *